US006441564B1

(12) United States Patent
Gu et al.

(10) Patent No.: US 6,441,564 B1
(45) Date of Patent: Aug. 27, 2002

(54) HIGH EFFICACY PULSED, DIMMABLE HIGH PRESSURE CESIUM LAMP

(75) Inventors: Hongyan Gu, Lexington, MA (US); Martin Muzeroll, Merrimack, NH (US); John Chamberlain, Somerville, MA (US); Jakob Maya, Brookline, MA (US)

(73) Assignee: Matsushita Electric Works Research and Development Laboratories Inc, Woburn, MA (US)

( * ) Notice: Subject to any disclaimer, the term of this patent is extended or adjusted under 35 U.S.C. 154(b) by 78 days.

(21) Appl. No.: 09/679,105

(22) Filed: Oct. 4, 2000

Related U.S. Application Data

(63) Continuation-in-part of application No. 09/333,173, filed on Jun. 14, 1999.

(51) Int. Cl.[7] ..... G05F 1/00

(52) U.S. Cl. ..... 315/291; 315/246; 315/271; 315/307

(58) Field of Search ..... 315/291, 246, 315/307, 308, 309, DIG. 4, 56, 160, 270, 271

(56) References Cited

U.S. PATENT DOCUMENTS

| | | | | | |
|---|---|---|---|---|---|
| 3,384,798 | A | * | 5/1968 | Schmidt | 313/184 |
| 3,746,914 | A | * | 7/1973 | Olson et al. | 315/47 |
| 4,137,484 | A | * | 1/1979 | Osteen | 315/209 R |
| 4,414,493 | A | * | 11/1983 | Henrich | 315/DIG. 4 |
| 5,637,965 | A | * | 6/1997 | Maya et al. | 315/358 |
| 5,684,367 | A | * | 11/1997 | Moskowitz et al. | 315/246 |

* cited by examiner

*Primary Examiner*—Don Wong
*Assistant Examiner*—Thuy Vinh Tran

(57) ABSTRACT

A dimmable electrical discharge lamp providing radiation and having a CRI of over 90 and a color temperature of between about 3000–4000° K even when dimmed by up to 40% of its rated power. The lamp contains a fill of a mixture of cesium, mercury and a rare gas. The fill is enclosed in a hermetically sealed polycrystalline alumina arc tube having an electrode at each end and the arc tube is enclosed in an outer jacket. The lamp is provided with a circuit for providing current to the arc tube. A low frequency wave simmer current is provided and one or more current pulses are superimposed on the simmer current. The gradient of the leading edge of the pulse is short whereby to generate a high electrical field and cause a high degree of ionization of the cesium.

12 Claims, 7 Drawing Sheets

HIGH EFFICACY PULSED, DIMMABLE HIGH PRESSURE CESIUM LAMP

RELATION TO OTHER APPLICATIONS

This application is a continuation-in-part of our application, Ser. No. 09/333,173, filed Jun. 14, 1999.

BACKGROUND OF THE INVENTION

This invention relates to a high pressure discharge lamp of cesium and mercury metal vapors whereby the correlated color temperature (CCT) and color rendering index (CRI) remain constant under dimming conditions. Even when dimmed by up to 40% of its rated power, the lamp has excellent color rendering (greater than 90) and favorable color temperature (3,000 to 4,000° K). In the present invention, we operate the lamp in a particular pulsed mode so the efficacy of the lamp is improved considerably while retaining a constant CCT and a constant CRI. We find that when using a fill comprising cesium in the lamp, even when dimmed, a color rendering index over 93–94 can be obtained in such lamps with efficiencies which are substantially improved when compared to lamps operated with a continuous waveform.

DISCUSSION OF THE PRIOR ART

High pressure metal vapor lamps are well known in the industry and have been used for a long time. In particular, high pressure sodium (HPS) vapor lamps have been used for street, roadway and high bay area lighting applications. Similarly, high pressure mercury (HPM) vapor lamps are well known and preceded the HPS lamps again for similar applications, mostly outdoors. Over the years, a variety of different metals have been tried to ameliorate some of the deficiencies of these lamps. However, no new practical dominent single species lamps have been introduced to the market over the last thirty years other than HPM and HPS for outdoor general illumination. The problem with HPM is that the efficiency is very low and it emits a very bluish light where the color and the CRI are not very desirable. On the other hand, the HPS lamp that has come after HPM has resulted in very high efficiencies on the order of 120 lpw, but again the CRI and the color are not all that desirable. As it turns out, the CRI is very poor. Many of the colors (red, orange, etc.) do not really appear in their true hue's under HPS illumination. That is why the majority of the HPS illumination has been confined to outdoor applications rather than indoor. The CCT of the HPS, as it turns out, is mostly on the order of about 2000–2500° K. The problem here is that the lamp is not a white light source. It is a very yellowish source and anything below 2500° K is not really considered a white light source. Therefore, the appearance of the light source itself, as well as the colors under it, are not very true renditions and it becomes highly undesirable to illuminate indoor objects with these kinds of light sources.

More recently it has been recognized that the color rendition could be improved to a certain degree by increasing the vapor pressure of the sodium in the lamp. The color temperature has been increased to 2800° K by using heat bands resulting in higher vapor pressure and whiter appearance. A more recent innovation has been the introduction of white color HPS light sources. These have the characteristics of CCT=2600–2800° K with a high color rendering index on the order of about 85. The efficiency, however, of these light sources is considerably lower, down to about 35–45 lpw depending on the power level of the source. Nevertheless, these light sources have found some application in the merchandise and indoor illumination, especially for retail window illumination, nation where red colors need to be accentuated. As it turns out, the red color rendition of the white HPS is very good and some retailers find it very attractive to illuminate red tones with this particular light source even though the efficacy is very low.

The white light has been achieved primarily by either pulsing the light source or increasing the vapor pressure considerably or a combination of both. Since many of these sources are used for specialized indoor applications, they tend to be low wattage, 100 or 200 watt level. The pulsing can be accomplished either by a high frequency or low frequency operation. Although the approach that has been on the market for quite a while, it is usually a hybrid where a magnetic ballast is utilized to run the light source at very high pressure and therefore, the system tends to be somewhat lower cost and one does not have to use an electronic ballast.

However, the whole system tends to be quite bulky and end users sometimes tend to be apprehensive about the size of the ballast. The other important characteristic of the white HPS source is that when it is dimmed, the color tends to deteriorate and it is not white anymore. It is yellowish. Therefore one cannot maintain either the CCT or the CRI of such light sources under dimming conditions. That certainly is a disadvantage in applications where one would like to introduce a certain degree of mood control or energy savings by dimming the light source.

SUMMARY OF THE INVENTION

The main objective of the present invention is to provide a dimmable light source with higher efficacy that can be substituted for a white HPS light source with comparable efficacy and having much higher efficiencies than an incandescent tungsten halogen light source.

It is also the objective of the present invention to provide a lamp with a very high CRI, close to 95 at various stages of dimming.

It is also the objective of the present invention is to provide a lamp with color temperatures on the order of 3000–4000° K.

Another objective of the present invention is to provide a lamp that can be dimmed to about 40–50% in power without substantially altering the CRI or the CCT.

Yet another objective of the present invention is to provide a dimmable light source that can be manufactured using existing technologies.

A further objective of the present invention is to provide a family of light sources that can be manufactured at higher power levels ranging from about 50 to 1000 watt depending on the requirements of the application.

Another objective of the present invention is to provide a light source that can have a much longer life compared to an incandescent tungsten halogen light source with close to twice the efficacy, at least three to four times the life and yet similar color and CRI with the added advantage of being dimmable without losing the whiteness or the appearance.

We have discovered that the radiation in a high pressure cesium lamp is primarily obtained from a highly ionized cesium plasma as explained herein. We have realized that we could increase the degree of ionization of cesium by a variety of techniques. As it turns out, the cesium has to be highly ionized and excited such that one obtains very broad band radiation. We found that most of the radiation is due to recombination emission and Brehmstrahlung radiation. The reason cesium works so well in this kind of discharge is the ionization potential is very low (3.1 eV) and therefore it is very easy to ionize.

Cesium's relatively high vapor pressure makes it convenient to operate at reasonable temperatures with a polycrystalline alumina envelope. Also, as it turns out, the cesium resonance emission is near 891 nm and once it is broadened and self-reversed, one branch moves toward the visible and ionic emission is superimposed on it so as to give a spectrum which is very comparable to a tungsten halogen light source and results in high CRI and color temperatures of 3000–4000° K depending on the ionization conditions. We have discovered that there are a number of characteristics of the pulsing approach which are unique to these light sources and have been found to be highly beneficial to increase the efficacy but also simultaneously to maintain constant CRI and CCT down to very low dimming levels. Furthermore, we have also found that under certain pulsing conditions we could actually change the color temperature from 3000° K to 4000° K depending on the application. Therefore a degree of control is provided where we can have a desired CRI and CCT that can be maintained under dimming conditions with an efficacy which is relatively high.

We have found that the light source of the present invention can be operated at a low frequency square wave and one or more current pulses can be superimposed in such a manner that the gradient of the leading edge is very short yielding a high electric field which leads to a high degree of ionization. If the simmer current (that is the arc sustaining current between pulses) is substantially smaller (in the order of 1 to 5%) compared to the peak currents imposed upon the arc tube, we find that the degree of ionization and the excitation of cesium ions is quite high and the efficiency can be improved by as much as 65–110% compared to continuous wave operation. This results in a more attractive light source and still retain the constant CCT and CRI under dimming. Superimposing a single or multiple pulse on a square wave at frequencies anywhere from 125 to 800 Hz has been tried successfully with pulse widths from 50 to 200 $\mu$s. The results are shown hereinafter in graphs and comments on the characteristics. These results demonstrated a superior approach although it may require a somewhat more expensive ballast resulting in an overall high performance, higher cost system.

DETAILED DESCRIPTION OF THE INVENTION

Figure 1A:
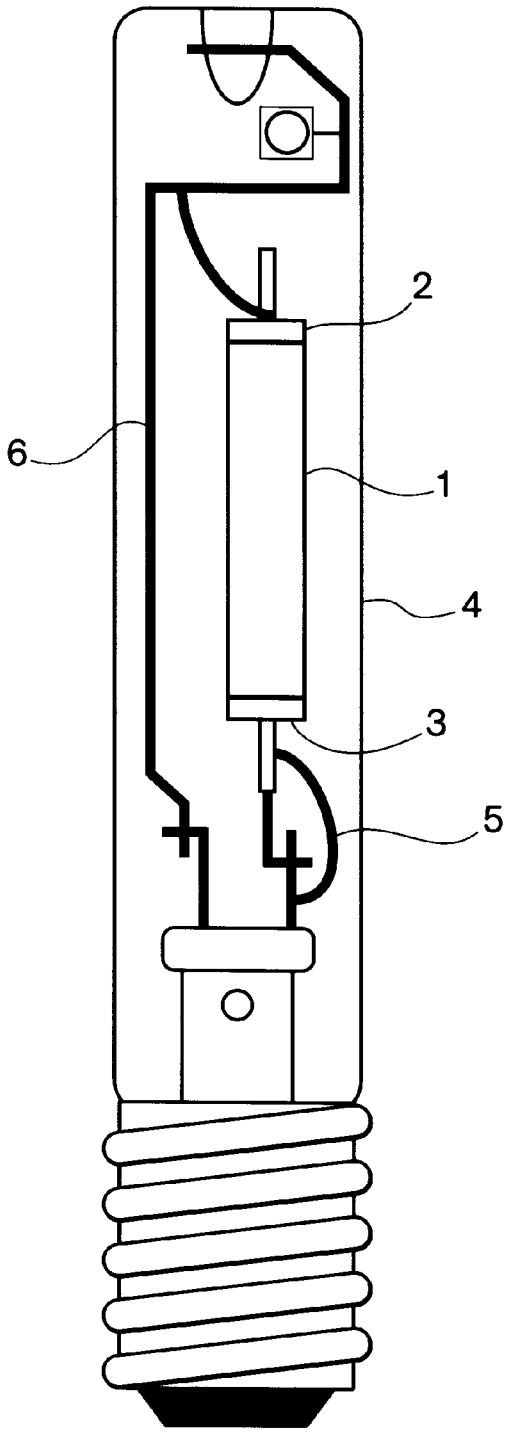
FIG. 1A shows a view of the PCA arc tube for high pressure cesium lamp and FIG. 1B shows a schematic diagram for generating the pulse current that gives the best results described herein.

As shown in FIG. 1A, the arc tube 1 that we used was made of polycrystalline alumina with dimensions of 6 mm ID, 8 mm OD and 40 mm overall length. The ends 2 were sealed in the conventional manner with niobium tubing attached to the tungsten electrodes 3 and sealed with an appropriate frit to the PCA. This particular arc tube was filled with 12% Cs by weight composition, the rest being Hg. The arc tube was also filled with 150 torr xenon gas for starting. The particular arc tube was then placed in an outer jacket 4 in a standard arrangement and connected to the circuit by wires 5 which is shown in FIG. 1A. The outer jacket 4 can have a filling of an inert non-reactive gas such as nitrogen at pressures between about 250–400 torr or can be kept under vacuum. In later experiments, some outer jackets were filled with nitrogen gas with a pressure between 250 to 400 torr. The arc tube 1 is fitted within the outer jacket 4 on a conventional harness 6.

Figure 1B:
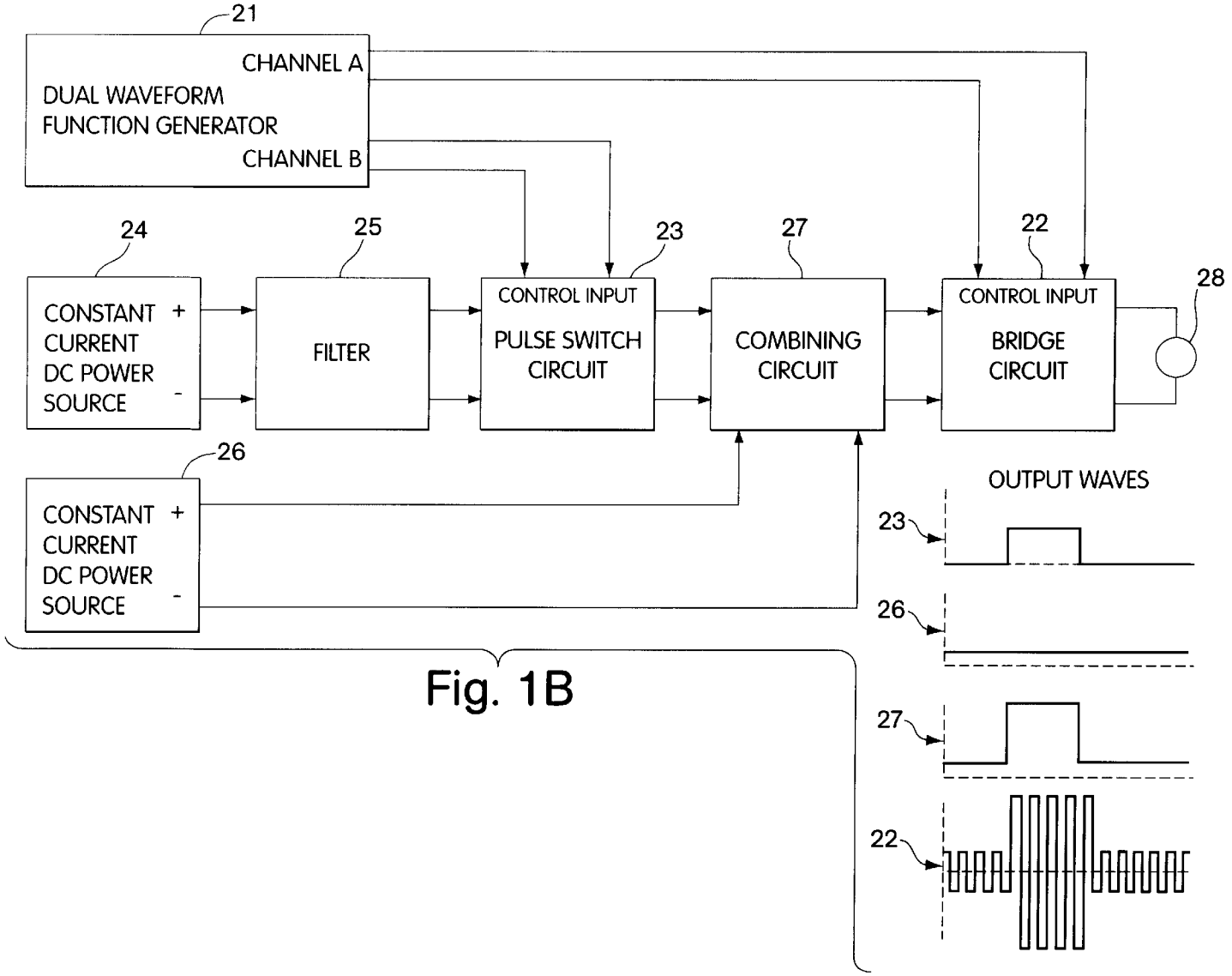

As shown in FIG. 1B, dual waveform generator 21 is programmed to output a square wave from channel A, and a pulse waveform from channel B. The square wave from channel A is fed into the control input of bridge circuit 22, and the pulse waveform from channel B is fed into the control input of switch circuit 23. Pulse power is supplied by constant current DC power source 24, through filter 25, and to the input of pulse switch circuit 23. The output of pulse switch 23 is switched on for the duration of the pulse waveform that appears at its control input. Square wave power is supplied by constant current DC power source 26. The square wave and pulse power are combined by combining circuit 27 (a pair of diodes), and fed into the input of bridge circuit 22. The bridge circuit switches its input power to its output with alternating polarities, such that the output polarity when the control input signal is high is the reverse of the output polarity when the control input signal is low. Lamp 28 is connected to the output of bridge circuit 22. The pulse modulation system, referring to FIG. 1B, had a substantial amount of flexibility whereby we could change the pulse rate, pulse height, simmer current level, duty factor and so on. This setup was assembled in the laboratory and gave us the opportunity to explore many different conditions. We have run many experiments where we change the pulse height, pulse width, number of pulses on a half cycle, duty cycle as well as the ratio of pulse height to simmer current. The root-mean square (RMS) current was determined by pulse height, pulse width, simmer current, and duty cycle. The range of peak current to RMS current ratio (crest factor) tested is between 3 and 5. The range of peak current density is greater than 300 mA/mm$^2$ and the simmer current density is less than 30 mA/mm$^2$ over arc tube cross-section. Some of the correlations of these parameters are shown in FIG. 4.

Figure 2:
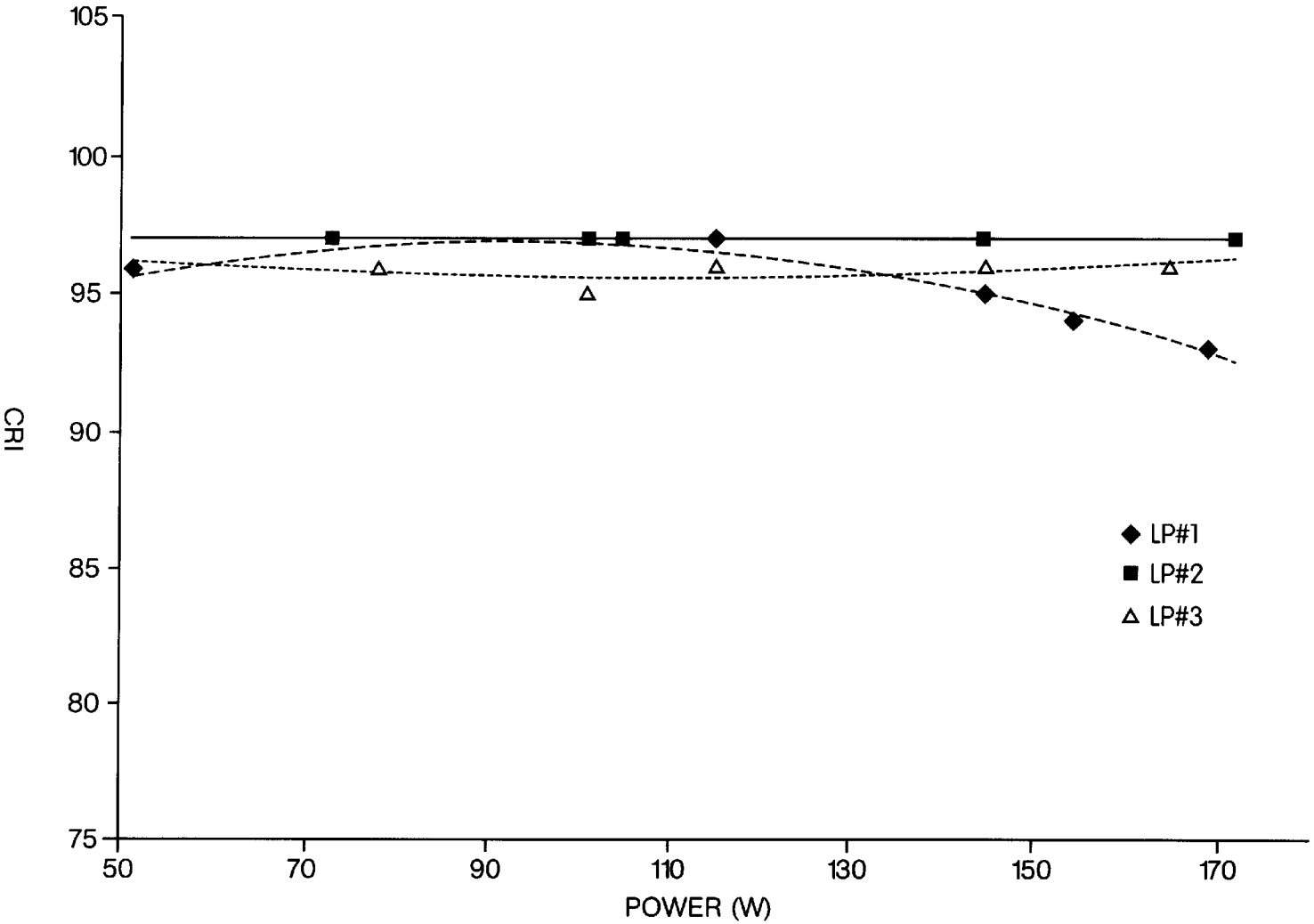
FIG. 2 shows the nearly constant color rendering index over 95 for a wide range of lamp wattages and operated under pulsed conditions.
Figure 3:
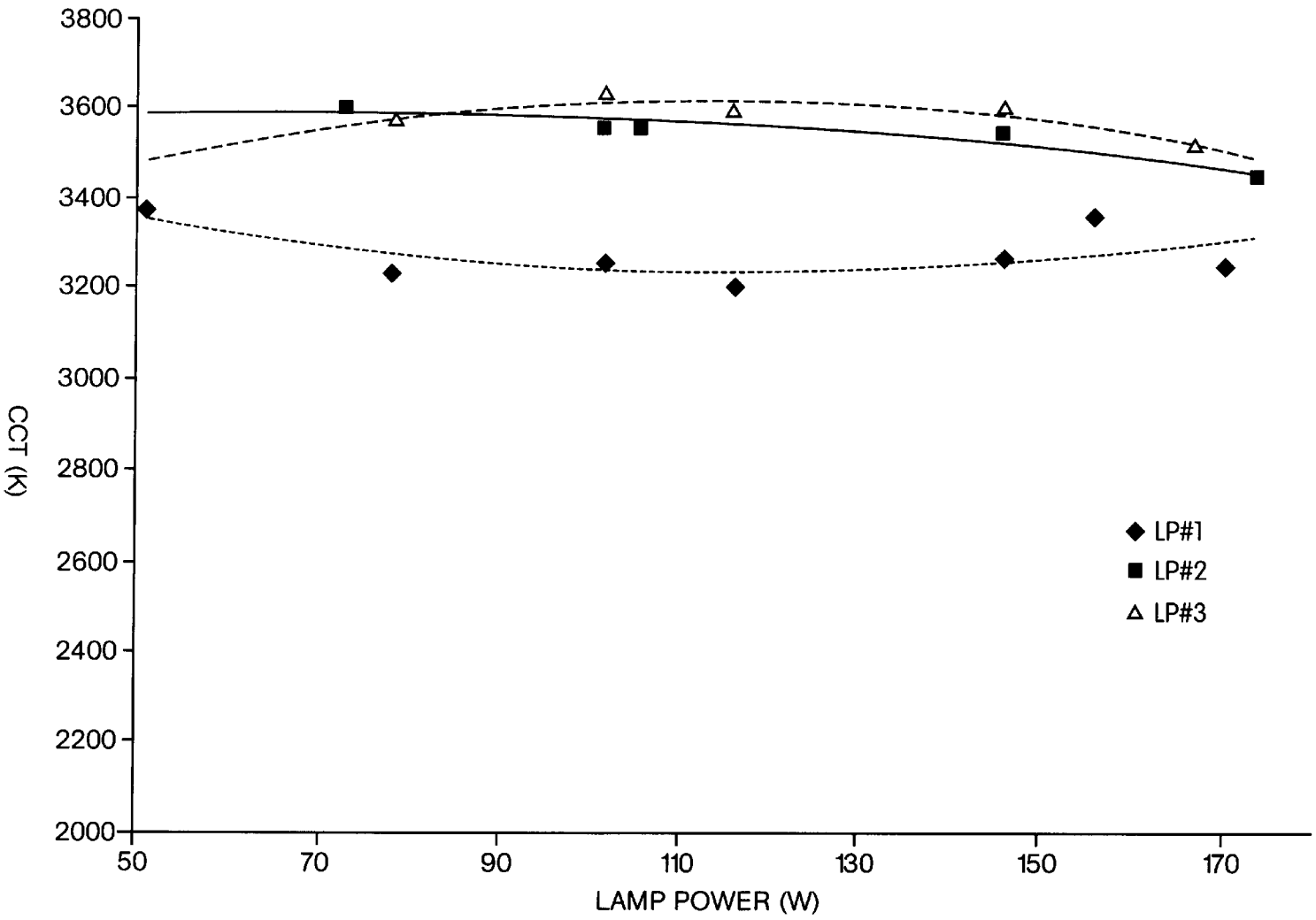
FIG. 3 shows the nearly constant color temperature as a function of lamp wattage operated under the pulsed conditions.
Figure 4A:
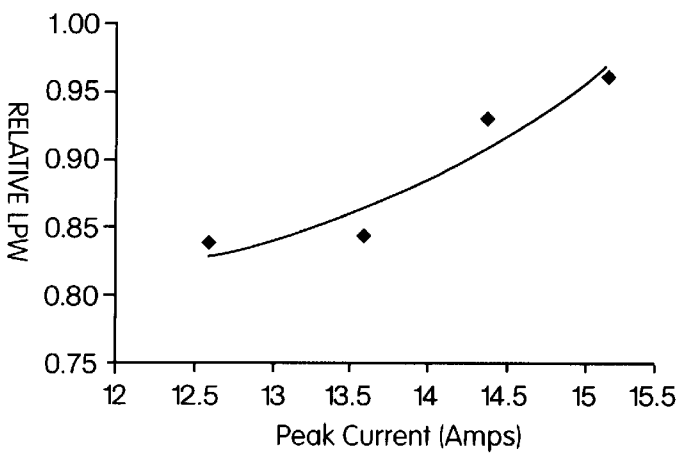
FIGS. 4A to 4D are curves illustrating the effects of peak pulse current, rms current, simmer current and pulse width on the relative efficacy of the Cs/Hg discharge light source.
Figure 4B:
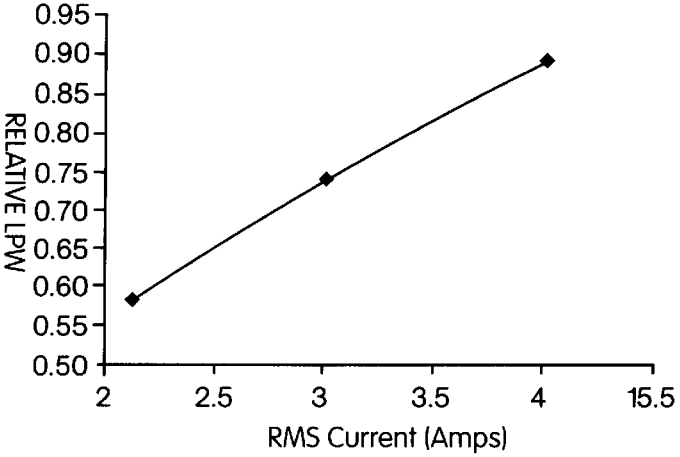
Figure 4C:
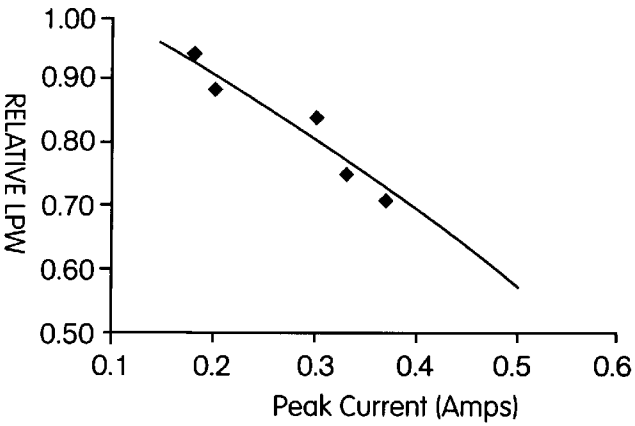
Figure 4D:
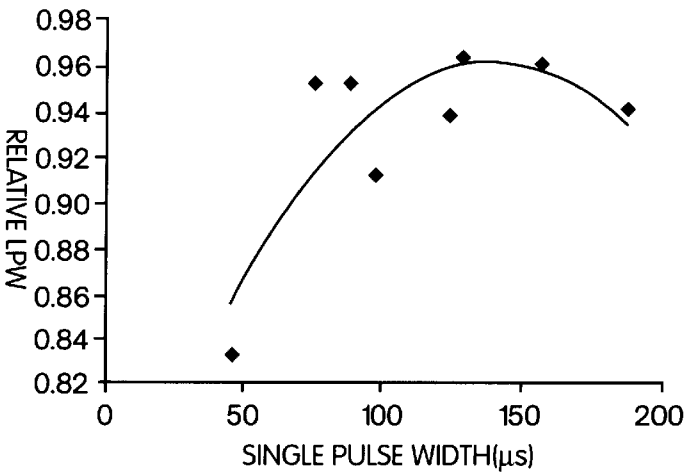
Figure 5:
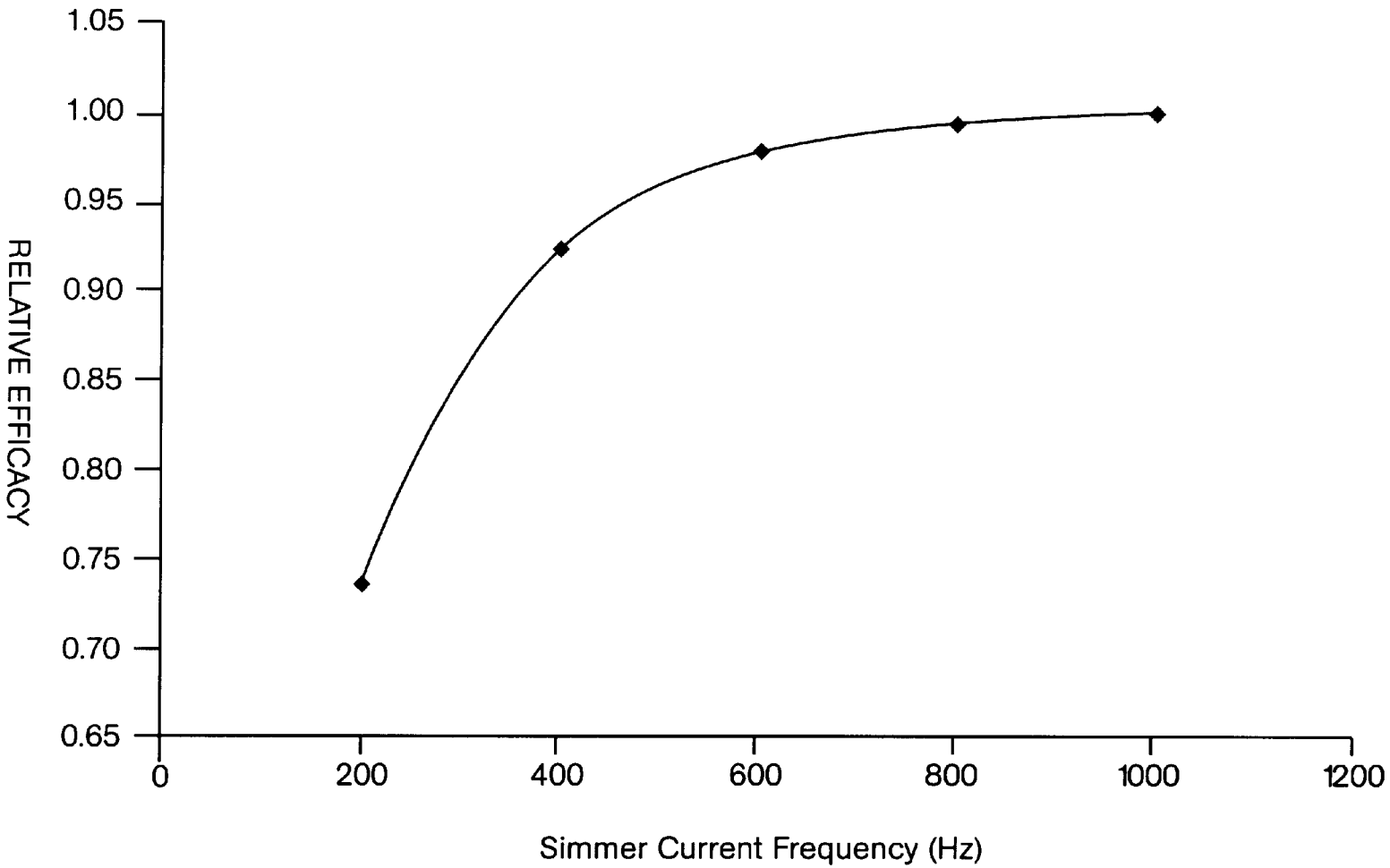
FIG. 5 shows the lamp luminous efficacy as a function of simmer current frequency. The efficacy increases significantly with a simmer current frequency from 200 Hz to 600 Hz and then increases gradually from 600 Hz to 1000 Hz.
Figure 6:
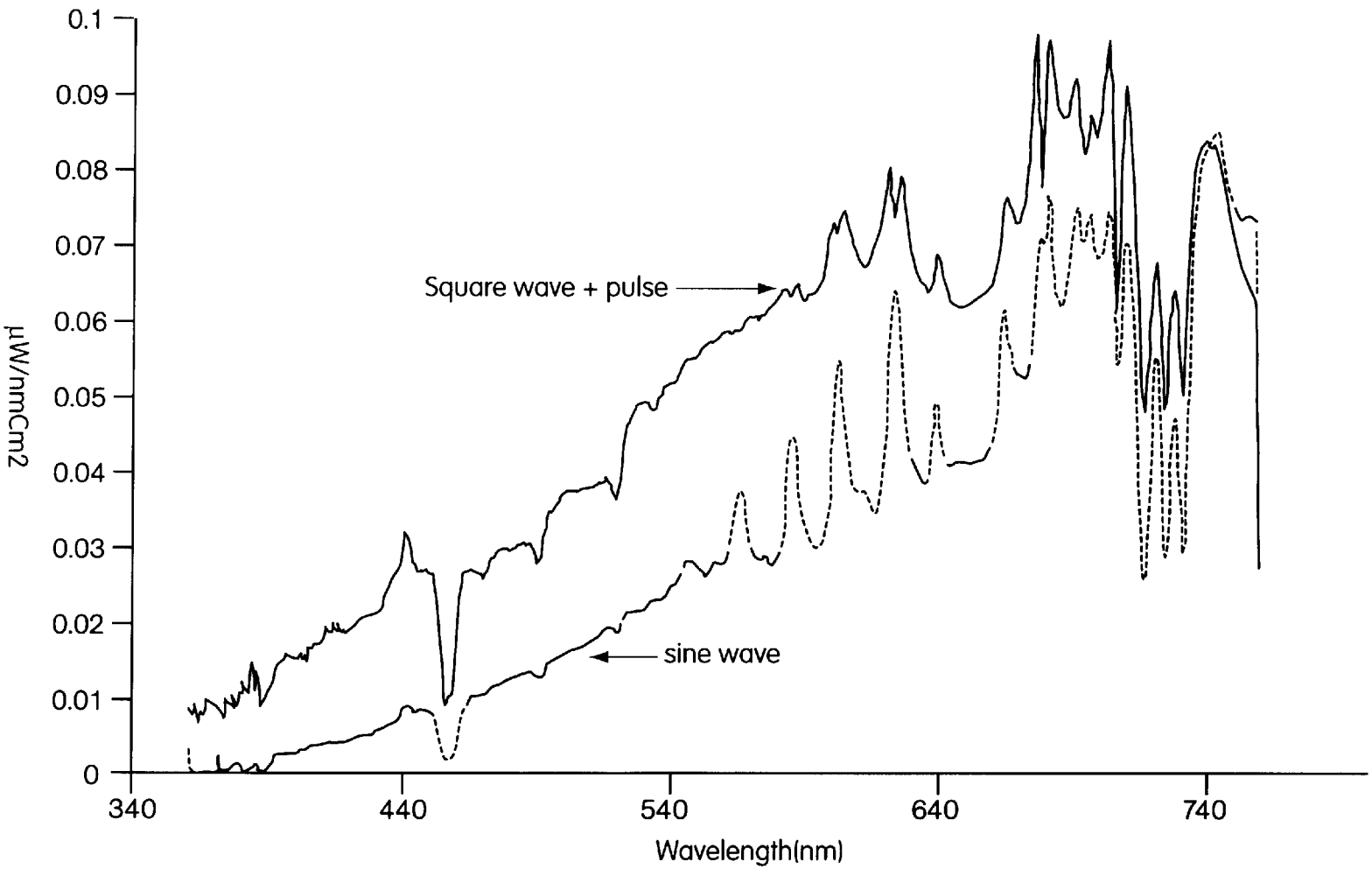
FIG. 6 shows the spectral output of the same lamp operated under sinusoidal wave conditions as well as pulsing conditions. As can be seen on the curves, there is a substantial amount of radiation which is added for the same power throughout the visible spectrum when the lamp is pulsed with preferred pulse conditions. This shows the superior performance of the superimposed pulse waveform vs. the sinusoidal waveform.

In FIG. 2 we plotted the CRI vs. lamp power for three test lamps. As can be seen, the majority values are over 95 which is very close to tungsten halogen over a wide range from almost 150 W down to about 50 W, a substantial amount of dimming with a constant color rendering index (CRI). In FIG. 3 we show the results for the correlated color temperature (CCT) and here, as can be seen for these particular lamps between 50 W and 170 W an almost constant CCT of 3300° K for lamp #1, 3500° K for lamp #2, and 3600° K for lamp #3 was attained. This is evidence that CRI and CCT are maintained at a nearly constant level when the lamps are dimmed from full power to below 40% of the rated power. The photometric experimental results demonstrated the trends that are desirable in obtaining this kind of performance and high efficacy as shown in FIG. 4. The general trend we found was that as frequency of the simmer current was increased from about 100 Hz to about 400 Hz, the efficacy increased. Beyond 400 Hz we found that the efficacy was not really affected for the single pulse modulation. However in a multiple pulse approach, as depicted in FIG. 5, the efficacy increases with simmer current frequency from 200 to 600 Hz and then reaches a plateau at 800 Hz. The amplitude of the simmer current can be reduced gradually as the repetition rate increases, and the arc eventually can be sustained by pulsing alone with the simmer current approaching zero.

In Table 1, following, we show a variety of efficiencies that are obtainable with this arc tube and the particular pulsing conditions. We also compare these with the sine wave efficacy. As can be seen from Table 1 there is a substantial increase in the efficacy of this light source without sacrifice on the constancy of the CCT and the CRI under dimming conditions. Efficacy of 37 lpw and 48 lpw was achieved using single and multiple pulse modulation technique, respectively. A wide range of CCT, from 3000K to 4000K, was demonstrated using different combinations of pulse shape, arc tube geometry, Cs/Hg composition and outer jacket fill. It is worth noting that under these conditions we have found that the higher the pulse current and the lower the simmer current the higher the efficacy of the cesium/mercury discharge. This can be understood in terms of a higher degree of ionization whereby the simmer current tends to bring about thermalization of electrons with fewer highly energetic electrons which have a hard time in ionizing and exciting the cesium metal atoms. On the other hand, as we increase the peak pulse current we have a higher proportion of high energy electrons and a high degree of ionization. This leads to highly excited cesium ionic states and therefore higher emission. So ideally, in order to get the best efficacy, we find that we have to increase the pulse peak current, decrease the simmer current, and maintain the square wave frequency somewhere around 300–800 Hz, (see repetition rate in Table 1).

TABLE 1

Typical Electrical and Performance Characteristics for Different Excitation Modes.

| Excitation Mode | Peak Current (A) | Repetition Rate (Hz) | Pulse Width (μs) | Power (W) | Efficacy (lpw) | CCT (K) | CRI |
|---|---|---|---|---|---|---|---|
| Multiple* Pulse | 15.7 | 800 | 88 | 160 | 48 | 3900 | 97 |
| Single Pulse | 14.2 | 250 | 240 | 110 | 37 | 3600 | 97 |
| 60 Hz Sine Wave | | | | 150 | 22 | 3500 | 95 |

*Note the 48 lpw result with multiple pulse was obtained in an arc tube with dimensions of 2.7 × 5.2 × 46 mm while the other results were obtained in a tube with dimensions of 6 × 8 × 40 mm.

Besides electrical excitation, a very important parameter needed to obtain the proper performance is the cold spot of the Cs/Hg amalgam. This determines the vapor pressure and therefore the density of the atoms. We have made a variety of thermal imaging temperature measurements and found that the best conditions are obtained when the cold spot where cesium/mercury amalgam resides is on the order of about 725 to 7–50° C. If we go to lower temperatures there is not enough cesium and the color temperature goes up substantially and the efficiency drops to undesirable levels. On the other hand if we go to much higher temperatures, we find that we are not sufficiently ionizing the cesium (which may be due to a lower plasma temperature and perhaps quenching) resulting in lower efficacy. So we found the optimum cold spot temperature was on the order of 725 to 750° C.

Additional experiments with multiple pulses have indicated some interesting results. For each half cycle of the square wave we changed the number of pulses from one to as many as four which we thought may give a higher degree of ionization. We have found that the multiple pulses have improved the efficacy by about 10–25%. In these experiments a number of parameters were varied. It is worth noting that the performance of the arc tube was somewhat sensitive to the pulse width. We have varied the pulse width from 20 microseconds t o about 500 microseconds and found some sensitivity of the efficacy on the pulse width, everything else being the same. More specifically, the repetition rate (200–1000 Hz) of the multiple pulses, the number of pulses (1–5), the current pulse widths (75–300 μs), the peak pulse current (12–19 A), the simmer current amplitude (0.2 to 1.0 A) were varied. The current crest factor is carefully determined for the proper frequency and pulse width to eliminate the acoustic resonance. We found that a higher current crest factor modulation combined with a wide pulse width would achieve stable operation much more easily than with a narrow pulse width. The pulse width was varied to provide dimming. A pulse width less than 20 microseconds is not suitable for stable operation while the upper limit of the pulse width is restricted by the lamp power, in our case 500 microseconds. In the majority of the cases we found the higher the ratio of current crest factor and the higher the ratio of peak pulse current to simmer current, the better the efficacy of the discharge. This is again consistent with our interpretation that the higher ionization resulting from higher plasma temperatures contributes to the efficacy.

It is worth noting we were able to stably operate the discharges for long periods of time with single, as well as multiple pulses in a variety of arc tube structures, without acoustic resonance. More specifically, we tried arc tube internal diameters of 2.7, 4.0, 5.0, 6.0 mm and arc tube lengths of 40, 56, 65 mm with fairly comparable results and no acoustic resonance. Table 1 shows a typical result with multiple pulses.

It is also worth noting that, in contrast with prior art where pulsing of metal vapors have been tried by Olstein, U.S. Pat. No. 4,137,484, and by Schmidt, U.S. Pat. Nos. 3,248,590 and 3,384,798, the key point of improvement in our experiments because of pulsing is really not the color change but rather the increase in efficacy. Olstein's experiments primarily indicated that by pulsing a high pressure sodium lamp the mercury and also the upper states of sodium which give blue-green emissions are excited thereby increasing the color temperature of the HPS at the expense of substantial reduction in efficacy. However according to the present invention this is not the issue. We find we can obtain the same color temperature and the same color rendering index and the constancy of these parameters under dimming with just a sinusoidal or square wave as well. The primary function of the pulsing is really to increase the degree of ionization of the cesium plasma in such a manner that one obtains higher emission in the visible and increases the efficacy. This is an important distinction from the prior art of pulsing experiments.

We have conducted a series of experiments where we changed the composition of cesium/mercury for identical arc tubes and identical pulsing conditions. Our experiments have indicated that the lower cesium composition at 12% cesium by weight was substantially more efficient than the 100% or 40% that we tried. This seems to suggest that the lower efficacy of these compositions relates to the vapor pressure being beyond optimum in practical arc tube configurations that were tried. Nevertheless our results for 12% cesium/mercury with the particular arc tube configuration have indicated that there is an optimum density of cesium which leads to a higher efficacy cesium light source.

We ran a series of experiments as a function of arc tube diameter with all other parameters being the same. We found that the efficacy tends to improve somewhat with smaller diameters. The diameters we tried were 6.0 mm, 4.0 mm, and 2.7 mm ID PCA arc tubes. Since the current density is higher at smaller arc tube diameters, we expect the plasma temperature to be somewhat higher thereby leading to higher efficacy.

During these experiments we found that the optimum composition of Cs/Hg is different for different arc tube diameters. Our most favorable conditions were obtained whenever the simmer current was maintained at less than 1 A and closer to maybe about 150 mA. The pulse current needed to be on the order of about 10–14 A and the pulse width, as mentioned above, typically on the order of about 100 to 150 microseconds for single pulse per half cycle operation. Under these conditions, typically, the lamp voltage was about 60 volts, rms current about 3 to 4 A and lamp power was about 150–200 W.

Of course, it is clear that the performance is affected by the loading on the lamp, the choice of the electrodes and whether we have an internal or external reservoir. As is well known, with an internal reservoir the amalgam resides inside the arc tube vessel. With an external reservoir, the amalgam is disposed outside the main arc tube vessel, however it is still within the electrodes' field which is connected to the main body. All of these can affect the cold spot temperature as is well known in the art of high pressure metal vapor discharges. Furthermore whether we have a gas or vacuum outer jacket effects the output of the light source. Generally, with Nitrogen, the cold spot temperature was slightly less than with vacuum, leading to somewhat smaller efficacy.

This invention discloses a dimmable high intensity discharge lamp which is operated under pulsed current conditions and whose color characteristics (CRI and CCT) are essentially unchanged over a wide power range, and whose efficacy is substantially higher compared to continuous wave operation. Without deviating from the spirit of this invention, many variations may be thought of in the construction of the arc tube, the particular shape of pulse(s), frequencies, etc. Any current pulse condition which leads to a high degree of ionization of the cesium plasma is within the spirit of this invention, a high degree of ionization being characterized as more than 30% on a time averaged basis.

While it is apparent that changes and modifications can be made within the spirit and scope of the present invention, it is our intention, however, only to be limited by the appended claims.

As our invention we claim:

1. An electrical discharge lamp providing radiation and having a CRI of over 90 and a color temperature of between about 3000–4000° K when dimmed up to 40% of its rated power, said lamp comprising:

a hermetically sealed polycrystalline alumina arc tube having an electrode at each end, said arc tube being enclosed in an outer jacket and including means for providing current to said arc tube; and a fill in said arc tube comprising a mixture of cesium, mercury and a rare gas; and means to provide a low frequency wave simmer current and means to superimpose one or more current pulses on said simmer current, the gradient of the leading edge of said pulse being short whereby to generate a high electrical field and cause a high degree of ionization of said cesium in a plasma in said arc tube whereby to enable the lamp to maintain a substantially constant CRI and color temperature when the lamp is dimmed.

2. The lamp according to claim 1 wherein the peak current density of such pulses is greater than 300 mA/mm$^2$ of arc tube cross-section and wherein the simmer current density is less than 30 mA/mm$^2$ resulting in current crest factors around 3–5.

3. The lamp according to claim 1 further including means for dimming said lamp up to about 40% of its rated power while its CCT and/or CRI remains substantially constant.

4. The lamp according to claim 1 wherein the applied pulses are superimposed on a square or sine current waveform and wherein the number of pulses per half cycle is at least one.

5. The lamp according to claim 1 wherein the applied pulses have pulse widths ranging from 20 $\mu$s to 500 $\mu$s and wherein the shape of the pulse is triangular, rectangular or sinusoidal.

6. The lamp according to claim 1 wherein the frequency of the simmer current under the pulse is between about 200 and 1000 Hz.

7. The lamp according to claim 1 wherein the applied pulse or pulses are at the leading edge of the square or sine wave of the simmer current.

8. The lamp according to claim 1 wherein the applied pulse or pulses are at any point in time of the half cycle of the simmer current.

9. The lamp according to claim 1 wherein the simmer current between the pulses while the pulses are on is zero.

10. The lamp according to claim 1 including means to adjust the pulsing to yield a light output spectrum that substantially approximates the spectrum of an incandescent or tungsten halogen lamp between 380 nm and 780 nm, while having an efficacy greater than 30 lpw.

11. The lamp according to claim 1 including means to adjust the pulsing to give a CCT range from 3000° K to 4000° K.

12. The lamp according to claim 1 wherein said outer jacket contains a vacuum or a filling of an inert non-reactive gas such as nitrogen at pressures between about 250–400 torr.

* * * * *